US005927295A

United States Patent [19]

Quinones

[11] Patent Number: 5,927,295

[45] Date of Patent: Jul. 27, 1999

[54] EYELASH COMB

[76] Inventor: Lydia E. Quinones, 15205 E. Deer Creek Rd., Chattaroy, Wash. 99003

[21] Appl. No.: 08/941,628

[22] Filed: Sep. 30, 1997

[51] Int. Cl.[6] ..... A45D 40/30; A45D 24/34; A45D 24/00; A45D 24/08

[52] U.S. Cl. ..... 132/216; 132/213.1; 132/150; 132/143

[58] Field of Search ..... 132/216, 213.1, 132/213, 107, 150, 159, 158, 124, 143, 217

[56] References Cited

U.S. PATENT DOCUMENTS

| | | | |
|---|---|---|---|
| 1,727,837 | 11/1929 | Miller et al. | 132/150 |
| 2,035,667 | 3/1936 | Payes et al. | 132/150 |
| 2,611,375 | 9/1952 | Bablon | 132/150 |
| 3,478,754 | 11/1969 | Martin | 132/159 |
| 3,654,939 | 4/1972 | Davidson | 132/88.7 |
| 4,135,527 | 1/1979 | Montiel | 132/88.7 |
| 4,627,451 | 12/1986 | Chang | 132/151 |

*Primary Examiner*—John J. Wilson
*Assistant Examiner*—Trang Doan
*Attorney, Agent, or Firm*—Wells, St. John, Roberts, Gregory & Matkin P.S.

[57] ABSTRACT

An eyelash comb is described in which an arcuate base is formed in an arcuate nature conforming in a complementary manner substantially to the natural contour of a human eyeball. A set of teeth are mounted to the base and follow the arcuate configuration of the base. The teeth are substantially parallel to one another and project axially from the base to outward ends. The teeth are spaced apart from one another along the arcuate base configuration between opposed end surfaces of the base and are configured to engage and comb through human eyelash hairs. A guard tooth is formed adjacent each end surface, with a blunt end spaced axially outward of the base further than the outward ends of the comb teeth. A handle is mounted to the arcuate base and extends therefrom. The handle is substantially centered between end surfaces of the base.

10 Claims, 9 Drawing Sheets

EYELASH COMB

TECHNICAL FIELD

The present invention relates to combs for eyelashes.

BACKGROUND OF THE INVENTION

Mascara is used frequently in the area of cosmetics for thickening and adding length to eyelashes. The mascara material has a tendency to gather eyelash hairs together in discrete groups, giving the appearance of very heavy and separate eyelash hairs. This is undesirable and eyelash combs have been developed to separate the hairs to give a more natural look without removing the mascara.

The typical eyelash comb includes a number of rigid comb teeth set in a base along a straight line that is parallel to the comb handle. The existing forms of eyelash combs are thus similar to regular hair combs, only much smaller in proportion.

The human eye is a very sensitive organ and natural instinct does not allow foreign objects to get into close proximity without a blinking reflex, in which the eyeball is protectively covered by the eyelid. An eyelash comb, being straight and including rigid, menacing teeth, rightly initiates the blink reflex. Users must at least initially overcome the reflex to blink, in order to effectively use the comb. However, even with such training, the typical straight comb is not a completely effective tool, since the eyelash hairs are distributed over the lower edge of the eyelid and naturally follow the curve of the eyeball. Thus even if the comb is used effectively, only a few of the eyelash hairs may be combed in a single stroke.

Even if the blink reflex is temporarily overcome, the comb can be used only to comb just those hairs engaged between the straight line of comb teeth. The combing process is thus not satisfactory, or the user must repeatedly try to reposition the comb to treat different areas of the eyelash before the process becomes satisfactory.

Another difficulty with conventional eyelash combs is the safety factor. The blink reflex, as noted above may be conditioned to allow close positioning of the comb. However, the geometry of straight line of comb teeth opposed to the curvature of the eyelash requires that few of the comb teeth be positioned close to the eye. Extreme care in judgement must be taken to avoid touching the eyelash comb teeth to the eyeball. This is a very difficult task and the straight line of comb teeth do not assist the user in safely positioning the comb. To the contrary, the straight line of comb teeth increase the difficulty. The user knows that only part of the comb teeth will be effective in engaging the eyelash hairs and will therefor tend to risk positioning the comb too close to the eyeball in order to do an effective job. The comb must also be used repeatedly at different angles to catch all the eyelash hairs. This further increases the risk of injury.

The present invention offers a solution to the above problems by provision of an eyelash comb that includes a curved set of eyelash combing teeth, set at a curvature approximating that of the human eyeball. Further the present comb includes safety features that will assist the user in safely and comfortably using the comb.

Thus, a first object of the present invention is to provide an eyelash comb that will effectively comb many if not all the eyelash hairs in a single stroke. Another object is to provide such a comb with a curved set of comb teeth that will enable safe positioning of the comb when in use.

A still further objective is to provide such a comb with a handle that is centered and substantially parallel to the eyelash comb teeth to enable accurate positioning of the comb teeth when in use.

The above and still further objects and advantages will become apparent upon reading the following description which, taken along with the accompanying drawings and claims, disclose a preferred form of the present invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
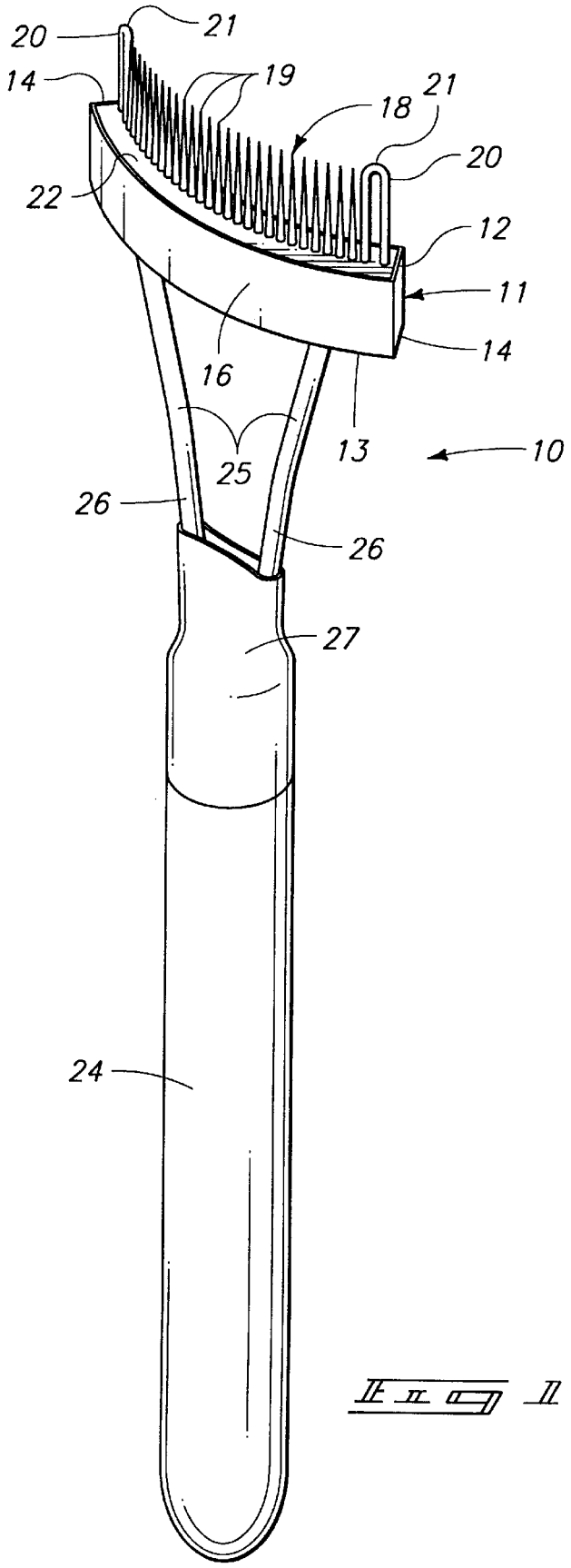
FIG. 1 is a perspective view of a comb exemplifying a first preferred form of the present invention.
Figure 2:
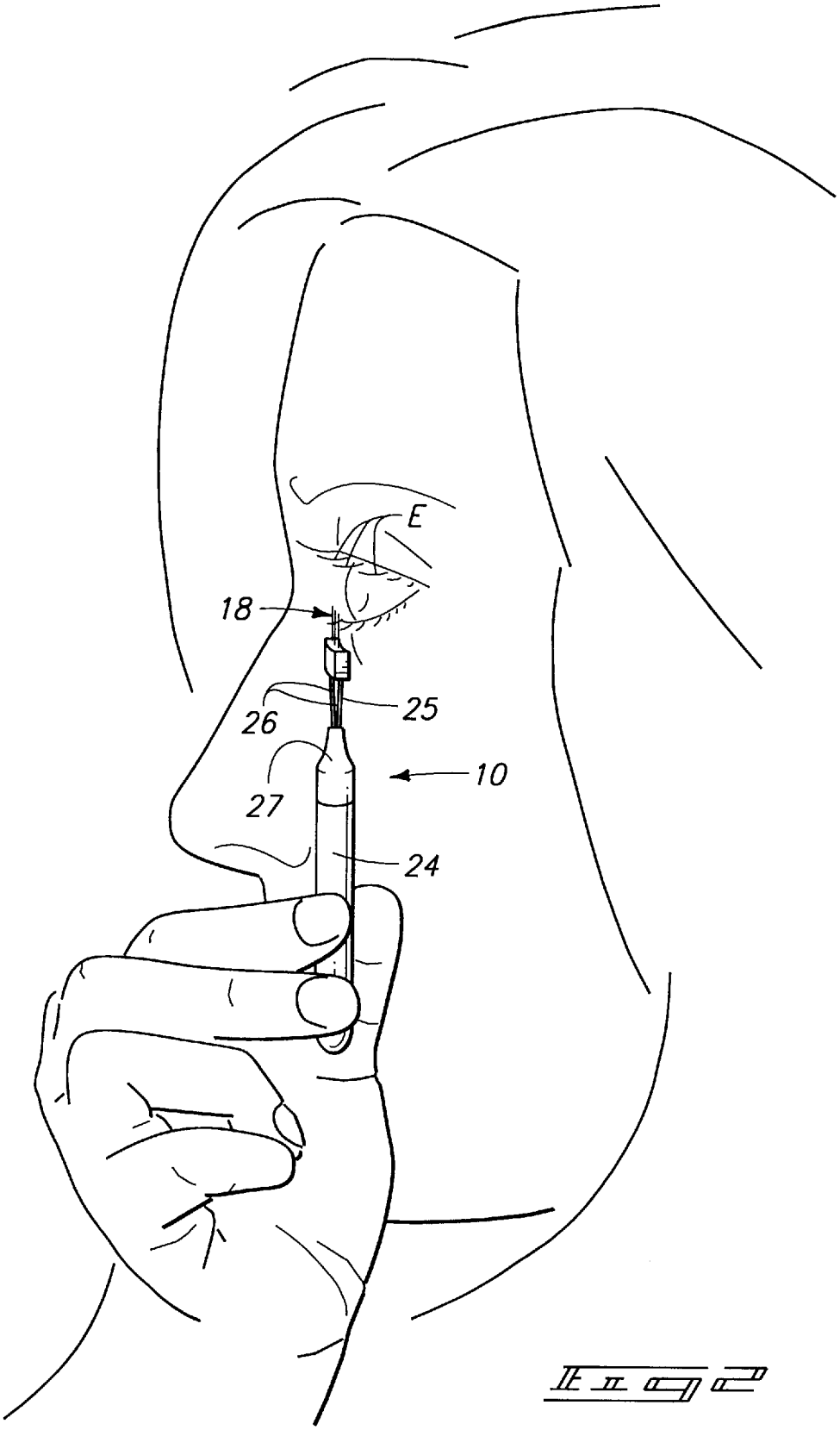
FIG. 2 is a perspective view of the comb in use.
Figure 7:
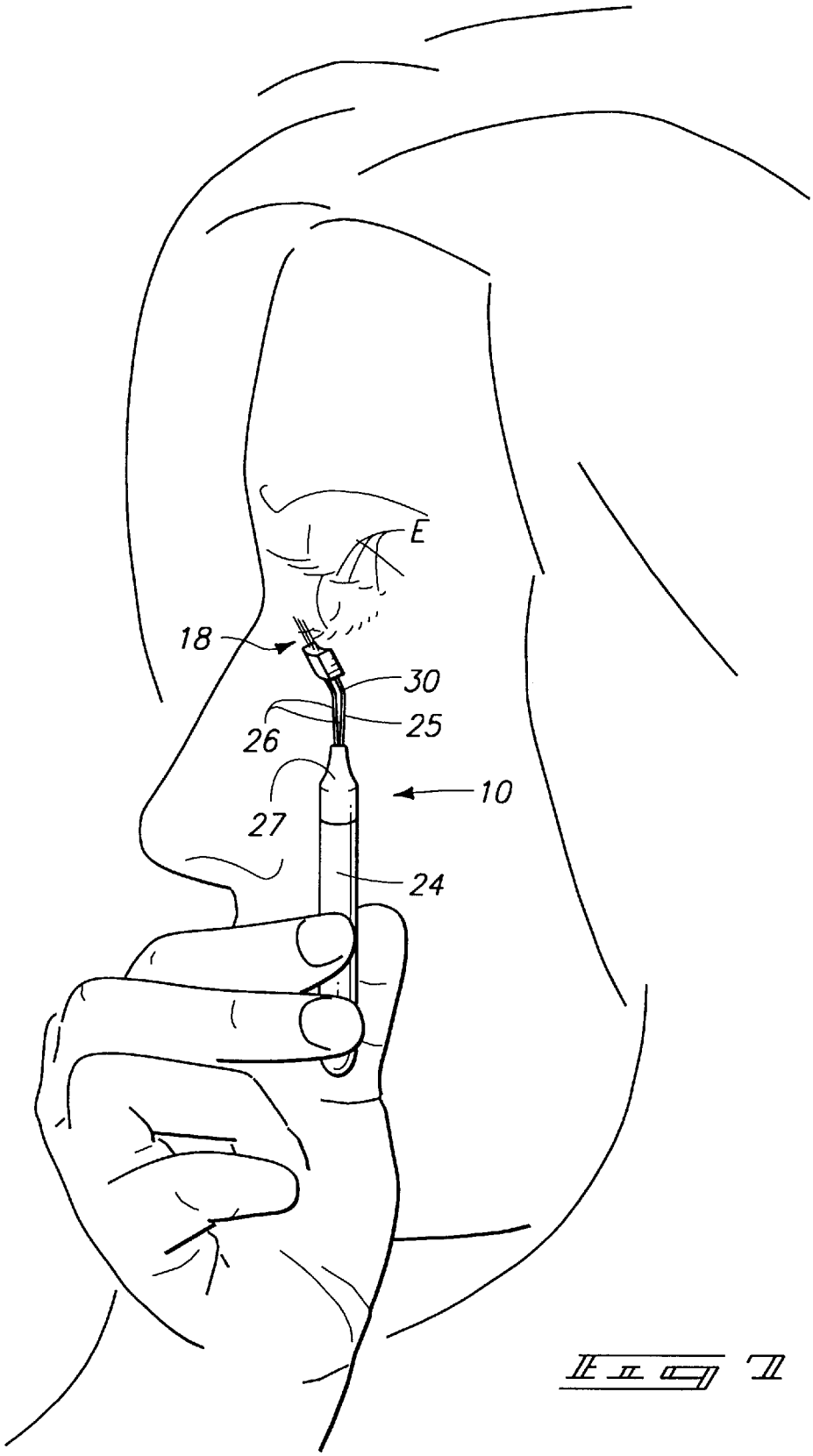
FIG. 7 is a view similar to FIG. 2 only showing use of a second preferred form of the present comb.
Figure 8:
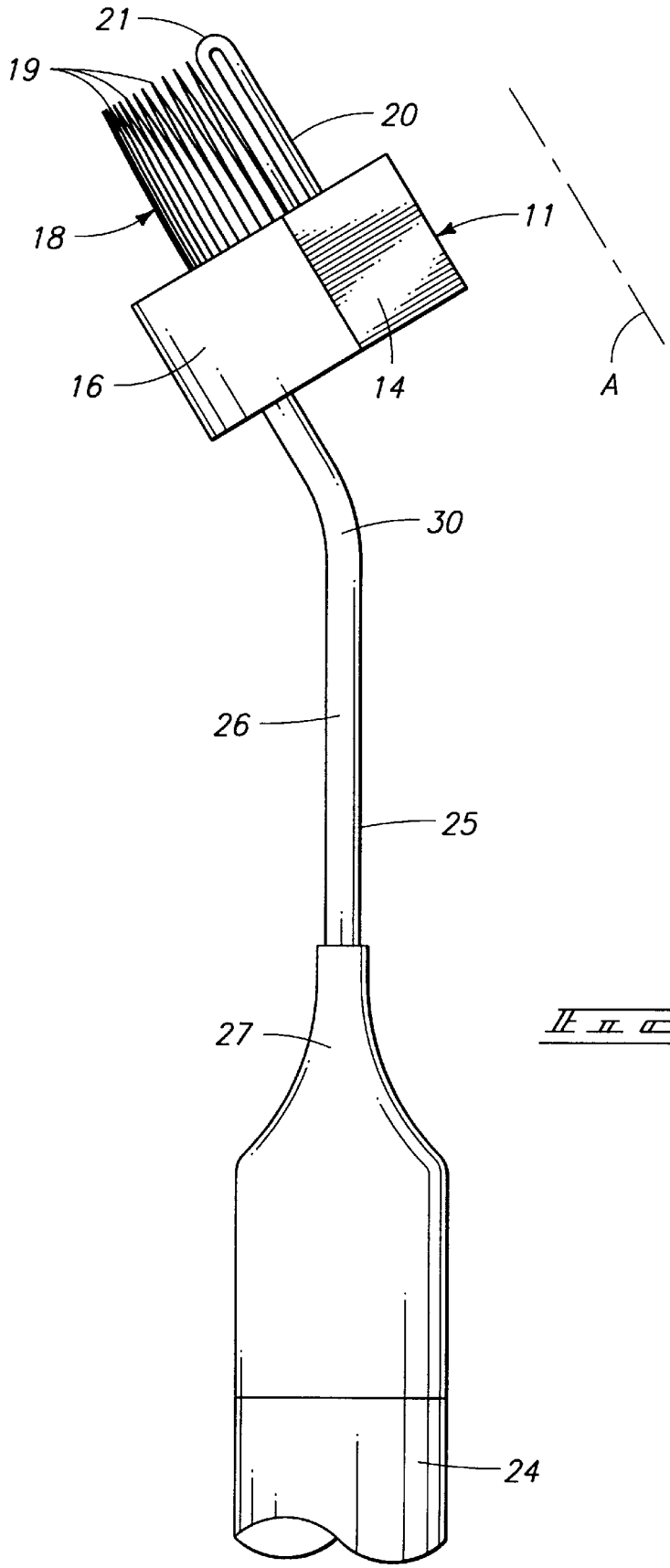
FIG. 8 is a side elevation view of the second preferred form.
Figure 9:
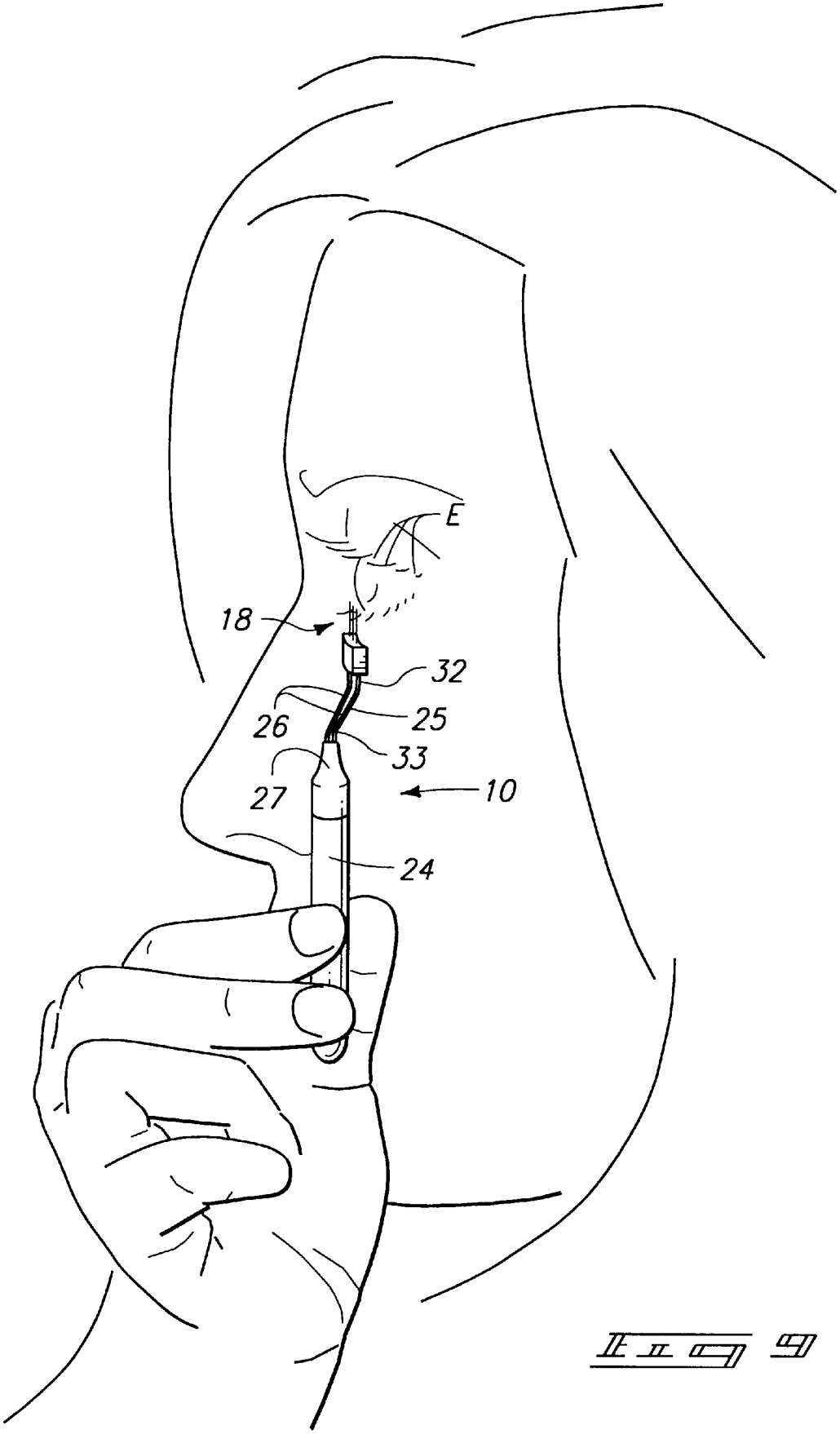
FIG. 9 is a view similar to FIG. 2 only showing use of a third preferred form of the present comb.
Figure 10:
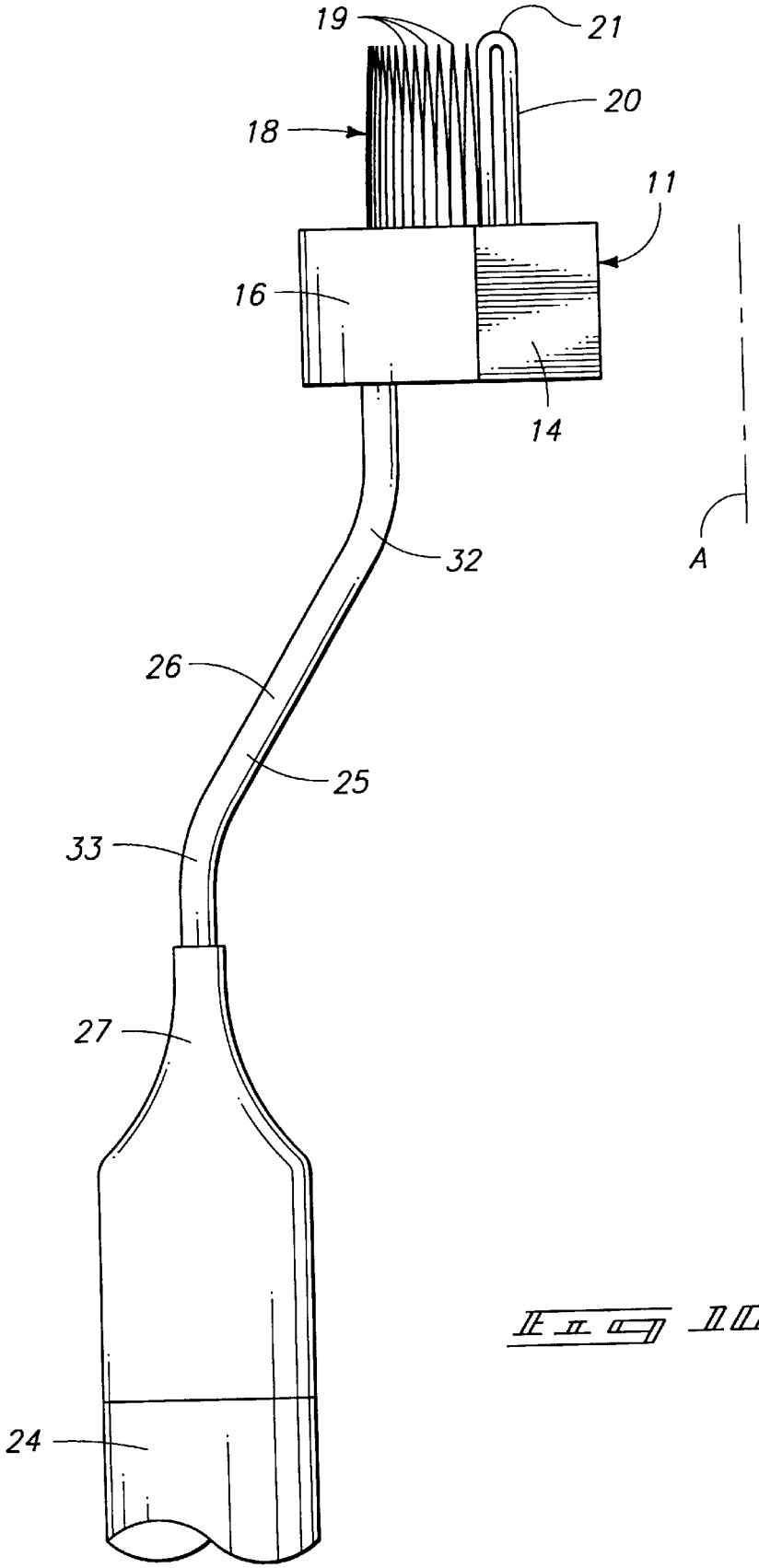
FIG. 10 is a side elevation view of the third preferred form.

Preferred embodiments of the present eyelash comb are shown generally in the drawings by the reference numeral 10. FIG. 2 shows the first preferred comb 10 in use, positioned by a user beneath the eye and ready to be moved upwardly to engage the eyelash hairs which are designated by the letter E. A second preferred form is shown in FIGS. 7 and 8. A third preferred form is shown in FIGS. 9 and 10.

Each of the preferred combs 10 includes an arcuate base 11 which is preferably formed of metal by conventional forming processes such as stamping, molding, or casting. It is also preferred that the base 11 be coated or plated with a durable, attractive surface such as gold plating. It is further contemplated that the base 11 may be formed of injection molded or otherwise formed plastic material.

Figure 3:
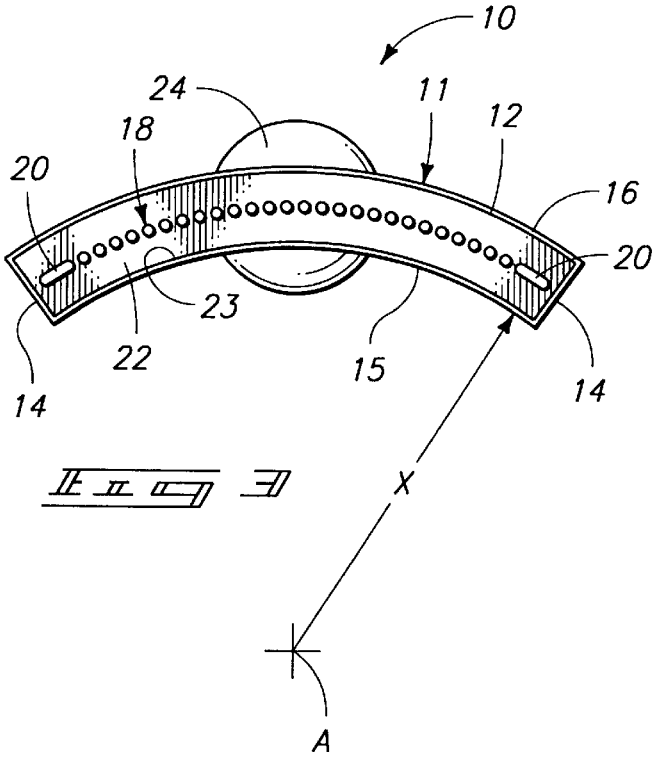
FIG. 3 is a top plan view of the preferred comb.

For purposes of further explanation, the base 11 is described as including top surface 12, a bottom surface 13 and opposed end surfaces 14. A concave inside surface 15, and a convex outward surface 16 join the end surfaces 14 and are preferably formed on a radii from an axis A (FIG. 3).

It is preferred that the radius (labeled X in FIG. 3) from the axis A to the concave inside surface 15 be approximately 0.75 inches. This curvature is selected to generally approximate the curvature of an average human eyeball, since the eyelashes and eyelids substantially conform to the curvature of the eyeball.

A set of comb teeth 18 are mounted to the base 11 and follow the arcuate configuration of the base 11. In a preferred form, the teeth are rigid and formed of an appropriate metal such as steel, and may be coated or plated with an appropriate hypo-allergenic material such as gold.

The teeth extend substantially parallel to one another and project axially (with respect to axis A) from the top surface of the base 11 to outward ends that are spaced from the top surface 12 of the base 11. The teeth extend to pointed ends 19 that are preferably similar if not identical to sewing needles. In the preferred forms, approximately 25– 32 teeth are evenly spaced along the arc of the base 11 between the end surfaces 14 to engage and comb through human eyelash hairs.

It is preferred that the spaces between adjacent comb teeth be selected such that the comb may be used without binding and pulling eyelash hairs. To this end, the spacing should be greater than the diameter of the eyelash hairs. A preferred spacing is within the range of approximately 0.005–0.01 inches.

Also in the preferred forms, a guard tooth 20 is formed adjacent each end surface 14. The preferred guard teeth 20 each include a blunt end 21 spaced axially outward of the base 11 further than the outward ends 19 of the comb teeth 18. The guard teeth protect the user from being pricked by the sharp ends of the comb teeth, especially those in close proximity to the end surfaces 14.

In one preferred form, the guard teeth are formed of wire, each being bent into a loop or bight which forms the blunt ends 21. The wire is preferably metal, and most preferably is selected from the same material as the comb teeth 18. Alternatively, the guard teeth 20 could be formed of plastic and be formed integrally with the base 11.

Figure 5:
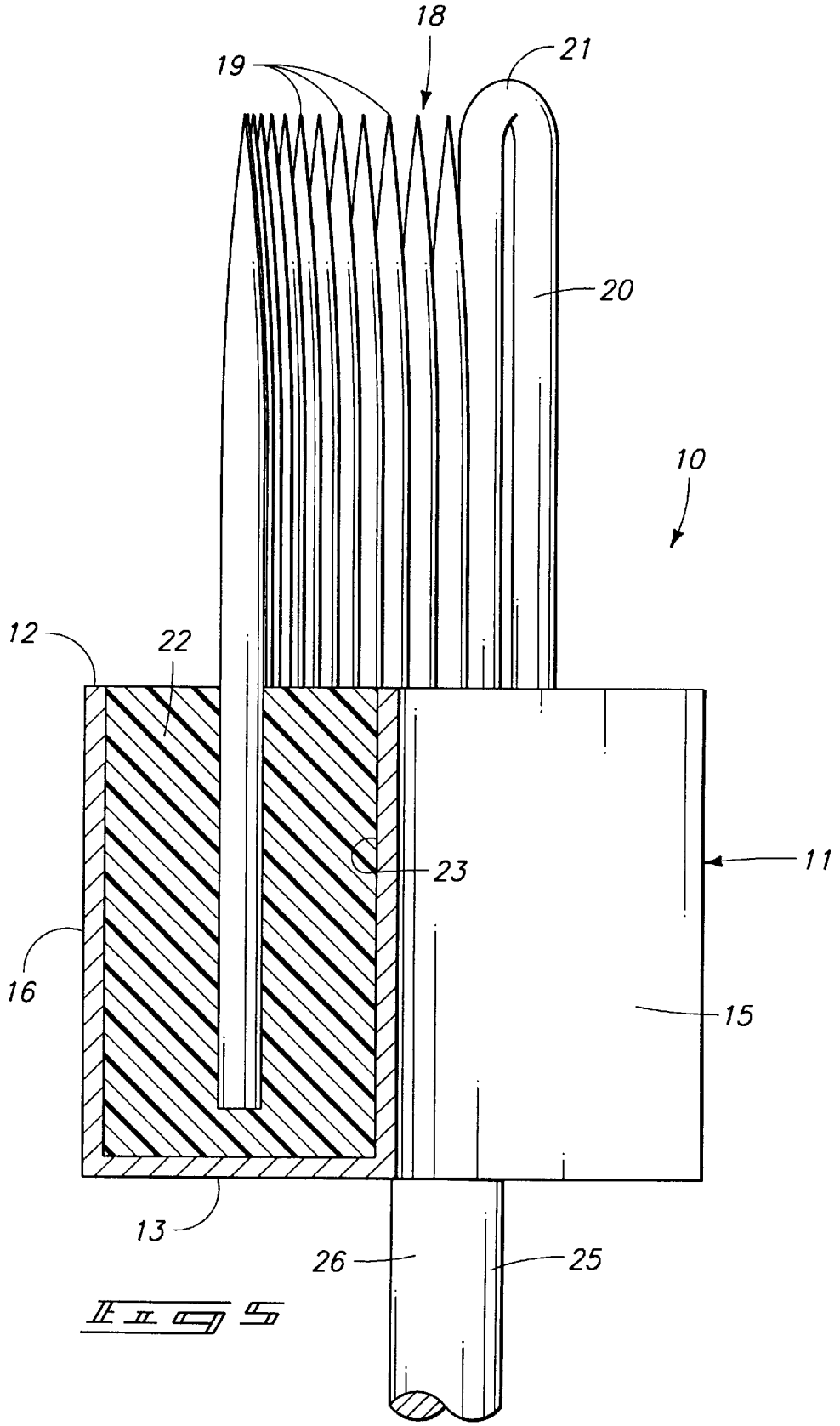
FIG. 5 is an enlarged sectional view taken along line 5—5 in FIG. 4.
Figure 6:
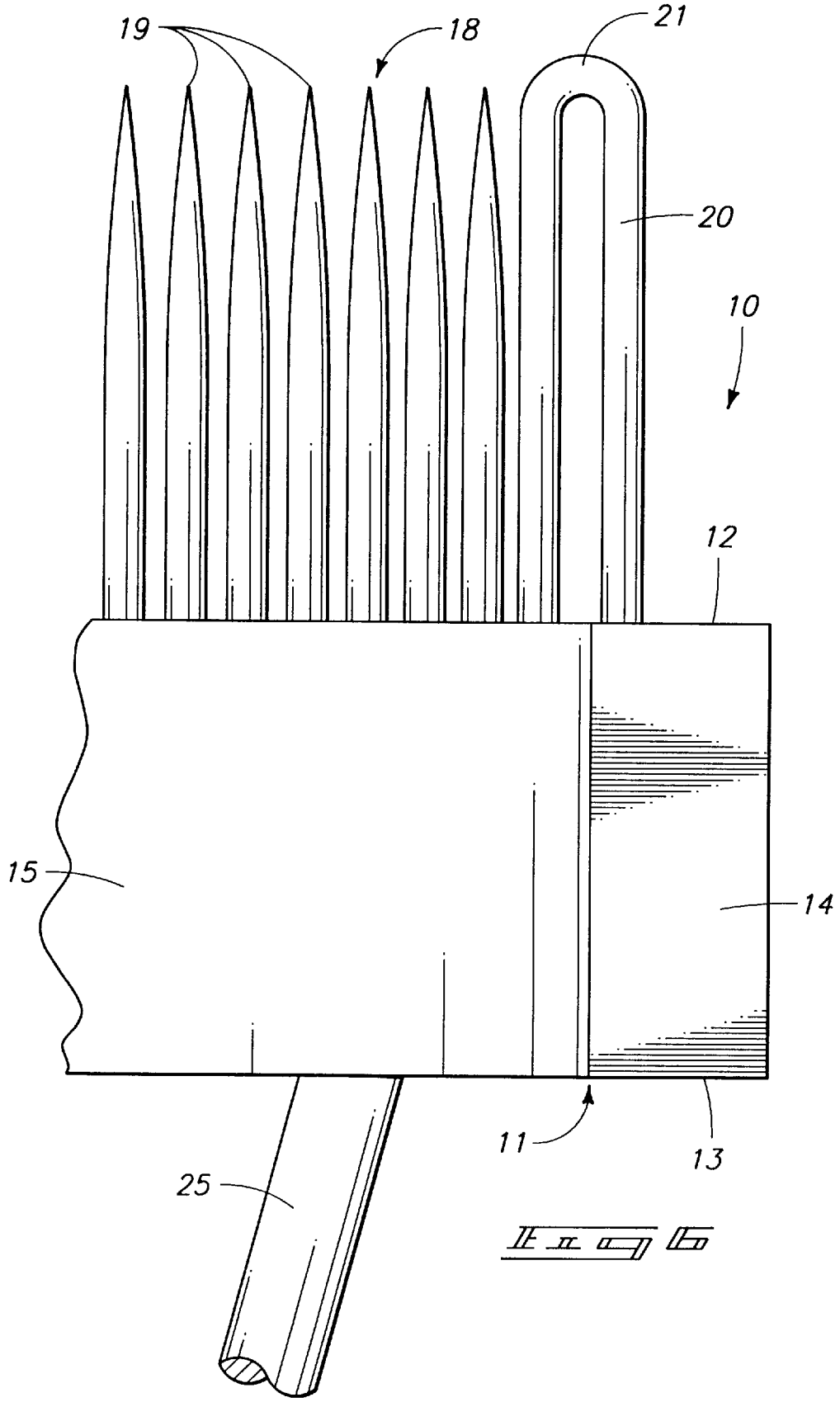
FIG. 6 is an enlarged detail view showing positioning of an end guard tooth; the opposed guard tooth being substantially a mirror image thereof.

The comb teeth 18 and the guard teeth 20 are preferably set in a plastic matrix 22 material within the base 11. In presently preferred forms, the bottom surface 13, the inside base surface 15, the outside base surface 16 and the end surfaces 14 join to form a receptacle 23 (FIG. 5) that opens at the top surface 12. The receptacle 23 preferably receives and molds the matrix material into the desired arcuate configuration. The base 11 and receptacle 23 could also be formed integrally as by plastic injection molding, in which case the teeth 18 and guard teeth 20 would be placed within the injection mold, or be otherwise affixed to the injection molded base.

In a preferred form, the teeth 18 are positioned within a plastic injection mold, and held in position while plastic is injected to form the base 11. Alternatively, cast epoxy may be used to secure the comb teeth 18 and guard teeth 20 in the desired axial relationship. As shown in FIG. 3, the teeth 18 and guard teeth 20 may be held in the desired arcuate relationship within the receptacle 23 while the epoxy material is poured. The teeth 18 and 20 are then held in position while the epoxy material cures to a rigid state. The hardened epoxy will then securely hold the subject teeth secure in relation to the base 11.

Figure 4:
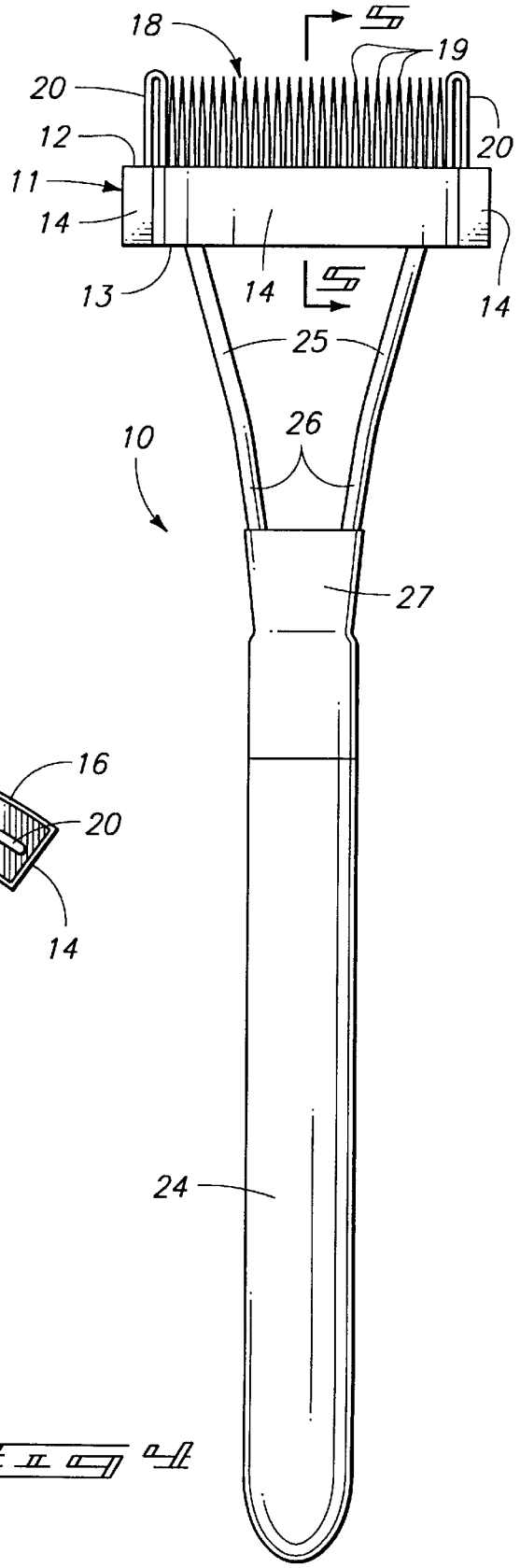
FIG. 4 is a rear view of the comb and handle.

In all preferred forms, a handle 24 is mounted to the arcuate base 11. It is also preferred that the handle be substantially centered between the base end surfaces 14 substantially as shown in FIGS. 3 and 4. Thus positioned, the handle 24 will allow the user to easily position the present comb 10 in a proper position in relation to the eye.

The above is advantageous over combs in which the handle extends to one side of the comb teeth, since the user will be holding the present handle 24 close to the cheek below the eye with the capability of bracing the fingers against the cheek for greater accuracy and secure positioning of the comb. Eyelash combs having the handle extending perpendicular to the comb tines force the user to hold the comb handle in a position where the hand is spaced to one side of the face.

The handle 24 is mounted to the base 11 in the preferred forms by way of a tang 25. In the preferred forms, the tang 25 is formed of a relatively rigid wire and includes two leg sections 26 that are secured (as by soldering or other appropriate fastening techniques) at their ends to the bottom surface 13 of the base 11. The leg sections 26 are separated to allow visual access through the area below the base 11. It is also possible that the tang, handle and base be formed integrally of a single material such as plastic, by an appropriate process such as plastic injection molding.

In the preferred forms, the legs extend axially from the bottom surface 13, then converge inwardly to the handle 24, substantially centering the handle between the end surfaces 14.

In the first preferred form, the tang and handle are oriented substantially along the axis of the handle. This places the handle directly below the base 11 as shown in FIG. 3.

In the second preferred form the tangs include bent portions 30 to angularly orient the base 11 in relation to the handle 24 (FIGS. 7 and 8). The relationship between the handle 24 and the axis A is shown in FIG. 7 as an acute angle, with the handle leading angularly away from the axis A.

In the third preferred form, the tangs include two oppositely bent portions 32, 33 that serve to offset the handle from the base 11 in the manner shown in FIGS. 9 and 10. Here the handle remains substantially parallel to the teeth 18 and the axis A, but is offset in a radial direction away from the base 11. The offset is sufficient to provide space between the user's thumb and cheek while maintaining the base 11 and teeth 18 substantially parallel to the handle (see FIG. 9).

The preferred handle 24 is formed of injection molded plastic, but could be another appropriate material. In the examples illustrated, the top end of the handle 24 is bored or provided with a recess to receive and fix the center, bottom part of the tang 25. The tang 25 may be secured to the handle 24 by provision of a clamping ferrule 27 at the top end of the handle. Another appropriate fastener or fastening technique may be used to secure the tang (such as adhesives, pins, or press fitting). The tang 25 might also be positioned within an injection mold for the handle 24 and be secured to the handle by the plastic material of the handle when molded. The tang 25 could alternatively be formed integrally with base 11 and the handle 24 by injection molding as suggested above.

Given the above technical description of the preferred form of my invention, operation thereof may now be easily understood.

To use any of the preferred forms of the present comb 10, the user simply grasps the handle 24, typically between a thumb, forefinger, and middle finger; and places the handle in substantial parallel alignment with the nose, with the base 11 and teeth 18 situated below the eye. The user may choose to use a mirror to assist proper positioning so the end surfaces 14 of the base are situated immediately below the respective corners of the eye.

In usage of the second preferred form, the user may place the curved portions 30 of the tang 25 so they come into contact with the tissues immediately below the eye. The handle 24 may then be oriented such that the teeth 18 are angled slightly away from the eye, but in the path of the eyelashes when the eyelid is closed. Alternatively, the handle may be shifted angularly away from the face as desired to change the angular orientation of the teeth 18 more toward the eye and allow space for the thumb between the cheek and handle 24.

In using the third preferred form, the comb may be grasped in the same manner as above, with the thumb braced against the cheek or at least in a position of close proximity to the cheek. The curved portions 32, 33 of the tang which offset the base will automatically position the base 11 and teeth in close proximity to the eye as shown in FIG. 9, and allow space for the thumb between the cheek and handle 24.

As suggested above for any of the three forms, the user may brace the hand against the cheek to facilitate holding the present comb 10 secure once the desired comb position is attained. Now, with the comb 10 properly aligned below the eye, the user may move the comb upwardly. As the comb is lifted, the comb teeth 18 will come into contact with the eyelash hairs and substantially all the hairs will be combed in one stroke.

Alternatively, the user may wish to simply position the comb in a stationary position directly under the eye, then move the eyelid downwardly in a blinking motion, so the eyelash hairs will engage and brush through the teeth 20. The eyelid is thus used to move the eyelash hairs through the comb teeth 18. Whichever technique is used, the guard teeth and the inward curved surface of the base may serve to protect the user from pricking the eyeball, or the tissues surrounding the eye opening.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An eyelash comb, comprising:

an arcuate base including a top surface, a bottom surface and opposed end surfaces, the base being configured in an arcuate nature conforming in a substantially complementary manner to the natural contour of a human eyeball;

a set of teeth mounted to the base and following the arcuate configuration of the base, the teeth being substantially parallel to one another and projecting axially from the top surface of the base to outward ends, said teeth being spaced apart from one another along the arcuate configuration between the opposed end surfaces of the arcuate base and configured to engage and comb through human eyelash hairs;

a guard tooth formed of a loop adjacent each end surface, the guard tooth including a blunt, folded end spaced axially outward of the base; and a handle mounted to the arcuate base.

2. The eyelash comb of claim 1, further comprising:

a plastic matrix within the arcuate base mounting the set of teeth.

3. The eyelash comb of claim 1, further comprising:

a tang secured to the bottom surface of the arcuate base and extending therefrom to mount the handle.

4. The eyelash comb of claim 1, further comprising:

a tang including two legs mounted to the base adjacent the end surfaces and wherein the handle is mounted to the tang substantially centrally between the two legs.

5. The eyelash comb of claim 1, wherein the handle is substantially parallel to the teeth.

6. The eyelash comb of claim 1, wherein the blunt, folded end is spaced axially outward of the base further than the outward ends of the comb teeth.

7. The eyelash comb of claim 1, wherein the base includes an inside and an outside arcuate surface extending between the end surfaces, the inside arcuate surface being formed on a radius along an axis of approximately 0.75 inches.

8. The eyelash comb of claim 1, wherein the inside arcuate surface is formed on a radius along an axis and wherein the handle is oriented at an acute angle to the axis.

9. The eyelash comb of claim 1, wherein the inside arcuate surface is formed on a radius along an axis and wherein the handle is substantially parallel to and radially offset from the axis.

10. The eyelash comb of claim 1, wherein the base forms a receptacle that is open along the top surface and wherein the teeth are set in a plastic material at least partially filling the receptacle.

* * * * *